United States Patent [19]

Stevens

[11] 4,359,618

[45] Nov. 16, 1982

[54] PUSH BUTTON SWITCH WITH SELF-INDICATING MESSAGE DISPLAY

[75] Inventor: Curtis R. Stevens, Mission Viejo, Calif.

[73] Assignee: Master Specialties Corporation, Costa Mesa, Calif.

[21] Appl. No.: 227,720

[22] Filed: Jan. 23, 1981

[51] Int. Cl.[3] ..... H01H 9/16

[52] U.S. Cl. ..... 200/314; 200/308; 200/312

[58] Field of Search ..... 200/308, 310, 312, 314

[56] References Cited

U.S. PATENT DOCUMENTS

| | | | |
|---|---|---|---|
| 3,754,243 | 8/1973 | Kaneko et al. | 200/314 |
| 3,947,651 | 3/1976 | Fuller | 200/314 |
| 3,988,557 | 10/1976 | Francke et al. | 200/314 |
| 4,044,213 | 8/1977 | Kinney | 200/308 |
| 4,129,766 | 12/1978 | Miyata et al. | 200/308 |

*Primary Examiner*—John W. Shepperd
*Attorney, Agent, or Firm*—Christie, Parker & Hale

[57] ABSTRACT

A push button switch having a self-indicating message display includes a push button capsule for being depressed into a housing for actuating a switch mounted in the housing. The push button capsule has a legend screen with a legend indicating use of the switch and a message screen for being displayed in the "on" position of the switch. The message screen fronts a shutter blade capsule mounted in the housing, and a pair of flexible shutter blades on opposite sides of the shutter blade capsule are curved toward one another over the message screen to black out the message when the switch is in the "off" position. The legend screen has light scattering capability that can black out the legend, when desired, and prevent reading the blacked out legend even in high ambient light conditions. The shutter blades are affixed to a movable lamp mounting base affixed to the push button capsule, and the shutter blades move down in response to the push button being depressed, to spread apart the shutter blades for exposing the message on the message screen to indicate the "on" position of the switch. The message screen is displayed without power supplied to lamps for illuminating the message, but the screen can be illuminated by back-lighting that is switched on when the push button is depressed. The legend also can be illuminated by back-lighting that is switched on when the switch is either in the "on" or "off" position.

9 Claims, 16 Drawing Figures

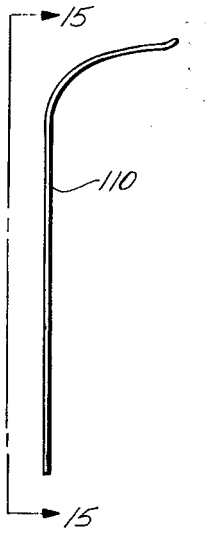
FIG. 14
FIG. 15
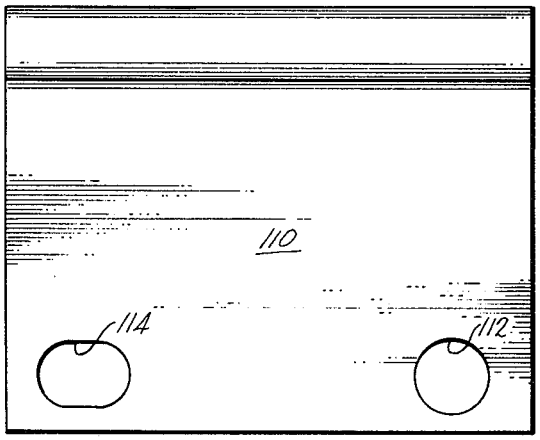

PUSH BUTTON SWITCH WITH SELF-INDICATING MESSAGE DISPLAY

BACKGROUND OF THE INVENTION

1. Field of the Invention

This invention relates generally to electro-mechanical switches, and more particularly to a push button switch having a self-indicating message display.

2. Description of the Prior Art

Push button switches are well known in which a push button projects from the front of a housing and a switch inside the housing is actuated by depressing the push button. The face of the push button can be illuminated from the rear to display a message, legend of the like, by lamps mounted behind the face of the push button. One type of push button switch has a self-indicating message display, in which the face of the push button provides a legend indicating the purpose or use of the switch, and an adjacent message indicating whether the switch is in the "on" or "off" position. This type of push button switch has numerous avionics uses, such as in instrument panels of aircraft. A legend on the face of these push button switches is typically blacked out when the legend is not intended to be read by the pilot. The legend can be backlighted to illuminate it when it is intended to be read. However, in high ambient light conditions, a pilot looking at the face of some push button switches can be read an apparently blacked out legend whether it is illuminated or not. It is desirable to provide a push button switch in which the legend is entirely blacked out when the legend is not intended to be read, so that the legend cannot be read in high ambient light conditions, while ensuring that the legend or a message on the push button is clearly readable, whether in high or low light conditions, when the legend or message is intended to be read.

This invention provides a push button switch having a self-indicating message display in which a legend or message can be entirely blacked out so it cannot be read even in high ambient light conditions.

In some instances, it is necessary to constantly illuminate a message screen on a push button switch to provide a back-lighting for its legend or message. It would be desirable to provide a switch in which the meassage screen is readable in ordinary or high ambient light conditions, without requiring constant electrical power to the lamps to provide back-lighting for the meassage or legend.

If continuous back-lighting is required for a legend on a legend screen, it is desirable that the brightness of the light be sufficient to ensure that the legend can be read in low as well as high ambient light conditions. However, brightly illuminated lamps being on for a long period of time can generate a large amount of heat; and therefore it is desirable to dissipate the heat to avoid an inordinate amount of heat transfer to the face of the push button.

The switch of this invention provides a message screen that is readable in ordinary or high ambient light conditions, without requiring electrical power for back-lighting the message. In instances where continuous back-lighting is required to read the legend on the legend screen, the illumination provided is at a level of brightness sufficient to make the legend readable in low as well as high ambient light conditions, and still the amount of heat generated by the lamp being continuously on is dissipated to avoid an unreasonable amount of heat transfer to the face of the push button.

SUMMARY OF THE INVENTION

Briefly, one embodiment of this invention provides a push button switch with a self-indicating message display comprising a housing, a switch mounted in the housing, a push button projecting from the housing, and a shutter blade capsule in the housing with a message screen adjacent the capsule. The push button is linked to a switch in the housing for actuating the switch when the push button is depressed into the housing. A shutter in the housing has at least a pair of shutter blades on opposite sides of the shutter blade capsule. The shutter blades are flexible and project above the shutter blade capsule and are normally curved toward one another to extend over the capsule to normally obscure the message screen. The shutter blades are movable into the housing in response to the push button being depressed into the housing when actuating the switch. This causes the shutter blades to spread apart to expose the message screen.

The flexible shutter blades provide a means for displaying the message screen without requiring electrical power for back-lighting the message screen. By depressing the push button, electrical contact can be made to illuminate a lamp for back-lighting the message screen if back-lighting is required, as in low ambient light conditions.

The flexible shutter blades close to obscure the message screen and open to expose it, without requiring any complex hinge or gear mechanisms to open or close the shutter.

In one embodiment, the push button switch includes a legend screen in the housing adjacent the message screen. The legend screen has a message on it, and light scattering means over the legend normally obscure the message. Back-lighting is provided behind the message screen for back-lighting the message to display it. The light scattering portion of the message screen entirely blacks out the message in low light, normal and high ambient light conditions. However, when the back-lighting is provided, the message is readable under all lighting conditions.

The push button also includes a heat sink for dissipating heat generated by the back-lighting to reduce undesired heat transfer to the face of the push button.

These and other aspects of the invention will be more fully understood by referring to the following detailed description and the accompanying drawings.

DRAWINGS

FIG. 14 is a side elevation view showing one of a pair of shutter blades;

FIG. 15 is a side elevation view taken on line 15—15 of FIG. 14; and

DETAILED DESCRIPTION

Figure 1:
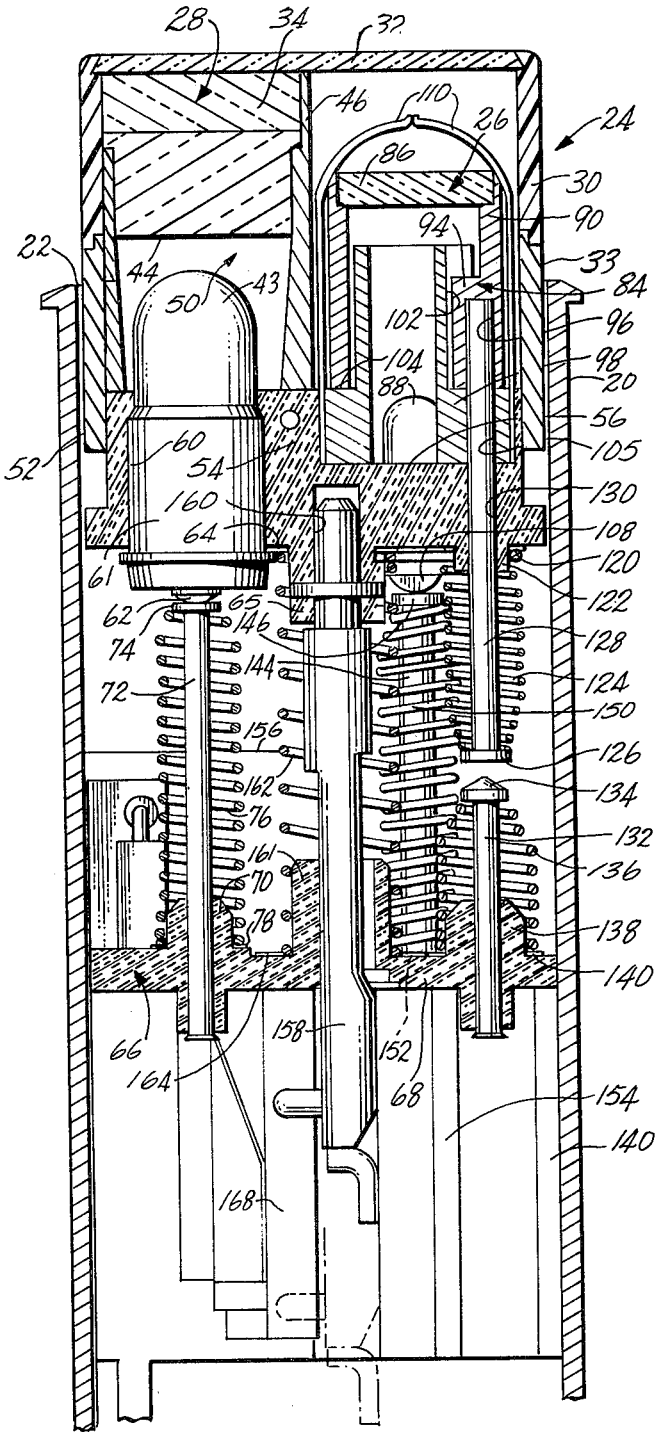
FIG. 1 is a fragmentary, cross-sectional view showing components of a push button switch according to principles of this invention.

The cross-sectional view of FIG. 1 shows components of a push button switch with a self-indicating message display according to principles of this invention. The push button switch includes an outer housing 20 having an upwardly facing top opening 22 and a hollow interior. The housing is made of a hard material such as metal or plastic. A push button 24 is movably supported in the top opening of the housing. The push button has a message screen 26 and a legend screen 28 mounted side-by-side in the push button and facing toward the front of the push button. The push button is depressed into the housing to actuate a switch mounted below in the housing. The message screen 26 indicates whether the switch is in the "on" or "off" position. In the illustrated embodiment, the word "on" is printed on the message screen. The message screen is blacked out to indicate the "off" position of the switch; and when the push button is depressed into the housing to actuate the switch, in a manner described below, the message screen is exposed to indicate the "on" position of the switch.

The legend screen 28 has a legend indicating the purpose or use of the switch. The legend is blacked out when the legend is not intended to be read. When the legend is to be read, the legend screen is back-lighted to illuminate the legend. The legend can be illuminated or blacked out independently of the "on" or "off" position of the switch, i.e., whether or not the message on the message screen is exposed.

The push button comprises a generally cup-shaped push button capsule 30 having a narrow, generally rectangular outer wall and a transparent plastic face 32 covering the upper end of the capsule. The rectangular outer wall of the capsule is opaque. The capsule has a hollow interior that faces down toward the interior of the outer housing 20. An open ended metal heat sink 33 is secured to the bottom of the push button capsule. The heat sink has the same generally rectangular configuration as the capsule 30. The heat sink thus forms a lower outer wall of the movable push button capsule. The heat sink is made from a material that dissipates heat generated in the interior of the capsule from operation of lamps for illuminating the legend screen.

Figure 2:
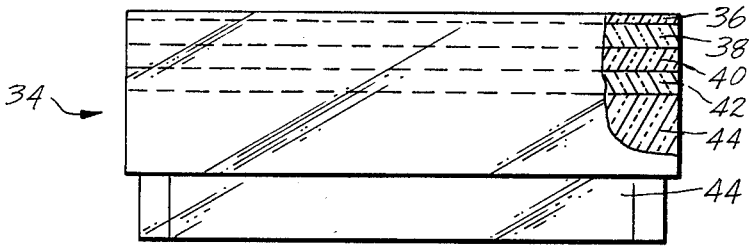
FIG. 2 is a side elevation view, partly broken away, showing a laminated lens.

The legend screen 28 is a generally rectangular block mounted inside the push button capsule immediately adjacent the underside of the transparent upper face 32 of the push button capsule. As illustrated best in FIG. 2, the legend screen is formed, in part, by a laminated lens 34 comprising a stack of four separate plastic pieces which include a translucent frosted outer piece 36 having a legend printed on its undersurface, a neutral density gray piece 38 adjacent the outer piece, a white diffuser piece 40 under the neutral density gray piece, and a color piece 42 in a desired background color under the white diffuser. The laminated lens has a completely black appearance that scatters ambient light incident on the outer face of the lens. This totally obscures the legend so that it cannot be read in ambient light incident on the outer face of the lens, even under high ambient light conditions. However, the legend can be read by back-lighting the lens by powering a pair of side-by-side lamps 43 (see FIG. 1) mounted adjacent the underside of the legend screen. The legend screen also includes a clear plastic light pipe 44 in contact with the underside of the laminated lens. The light pipe provides a means for transmitting light to the lens without losing any significant amount of the light produced by the lamps 43. The lamps generate a substantial amount of heat if they are on for a long period of time. This heat is dissipated away from the face of the push button, in part by the heat sink 33, so the push button face is not hot to the touch. The light pipe also allows the lamps 43 to be spaced a good distance from the push button face, which also reduces heat transfer to the face of the push button.

The legend screen 28 is mounted in the top portion of a light splitter having an elongated, upright light-splitting and reflecting blade 46 that divides the upper inside portion of the push button capsule into two separate side-by-side hollow regions. The blade is opaque and extends to the undersurface of the face 32 of the push button for preventing light transmission from one hollow region to the other. Posts 48 on the side of the light splitter opposite the blade cooperate with the blade for supporting the lengend screen above a hollow interior region 50 below the screen. The base of the light splitter has a pair of side-by-side openings, and the lamps 43 project through these openings into the hollow interior region 50 below the legend screen.

Figure 4:
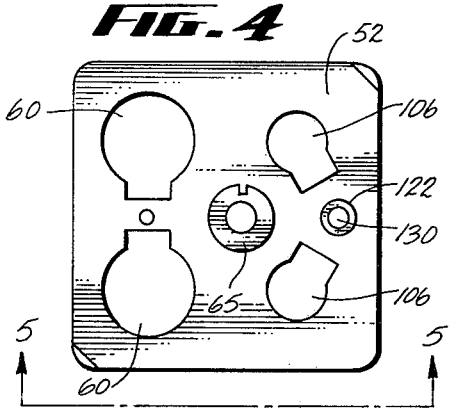
FIG. 4 is a rear elevation view taken on line 4—4 of FIG. 3.
Figure 3:
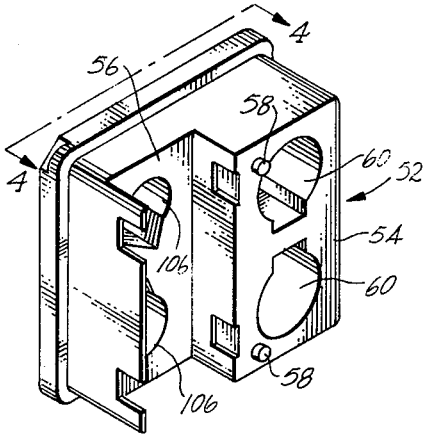
FIG. 3 is a perspective view showing a lamp mounting base.
Figure 5:
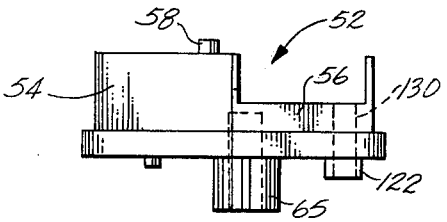
FIG. 5 is a side elevation view taken on line 5—5 of FIG. 4.
Figure 7:
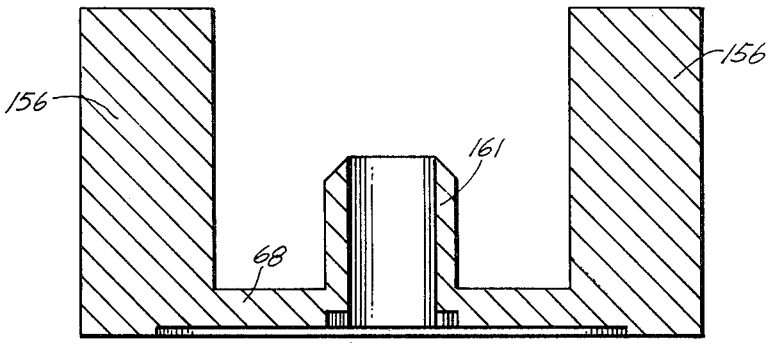
FIG. 7 is a cross-sectional view taken on line 7—7 of FIG. 6.
Figure 6:
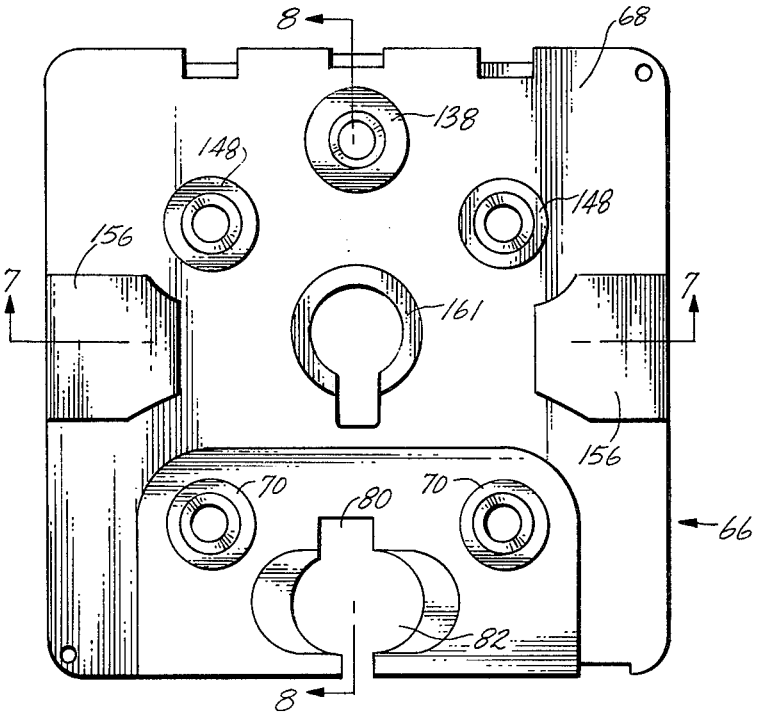
FIG. 6 is a top view showing a contact spring mounting deck.
Figure 8:
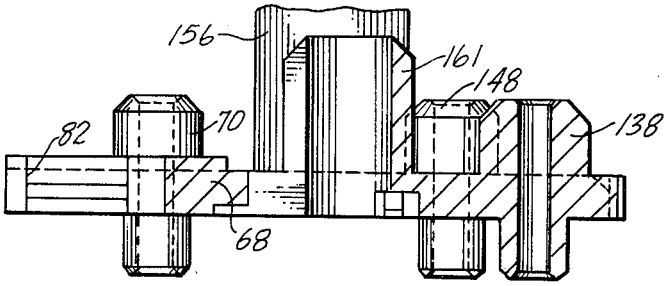
FIG. 8 is a fragmentary, cross-sectional view taken on line 8—8 of FIG. 6.
Figure 9:
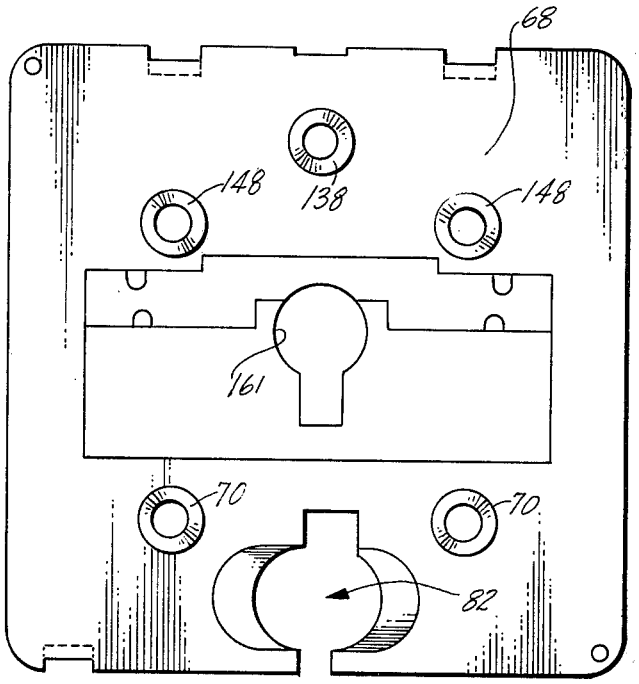
FIG. 9 is a bottom view showing the contact spring mounting deck of FIG. 6.

FIGS. 3 through 5 show a lamp support base 52 to which the light splitter is mounted. As shown best in the perspective view of FIG. 3, one half of the lamp support base is formed as a raised, generally rectangular block 54, and the other half of the base is formed as a generally rectangular recess 56. Pins 58 on the block 54 register with holes on the underside of the light splitter to hold the light splitter in a fixed position on the block. A pair of side-by-side lamp receptacles 60 extend through the block. An electrically conductive base 61 of each lamp 43 is fitted into a corresponding receptacle from the underside of the lamp support base. Each lamp 43 has an electrical contact 62 at its base facing down below the lamp support base. An electrically conductive lamp bus 64 (shown in FIG. 1) makes electrical contact with the base 61 of each lamp. The bus encircles a post 65 projecting down from the center of the lamp support base. The bus provides an electrical path from a common ground (described below) to each lamp contact 62. In the illustrated embodiment, 28 volt 40 milliamp lamps 43 are used for back-lighting the legend screen.

FIG. 1 shows a fixed contact spring deck 66 spaced below the lamp support base. The contact spring deck, which is shown in more detail in FIGS. 6 through 9 includes a generally rectangular base plate 68 secured at its edges in a fixed position inside the housing to extend across the entire width of the housing. A pair of spaced apart, vertically extending pin mounting sleeves 70 are aligned below the contacts 64 on the lamps 43. The pin mounting sleeves hold separate electrically conductive pins 72 (see FIG. 1) in a fixed position and in contact with the lamp contacts 62 of the lamps 43. Each pin 72 has an electrically conductive top flange 74 that makes contact with a separate lamp contact. The flanges are spring biased into continuous contact with the lamp contacts by corresponding elongated contact springs 76. Each contact spring is a coil spring having its top portion tapered in a manner akin to a volute spring. The springs surround the contact pins, and the base of the springs is held in place by the tops of the pin mounting sleeves 70. The tops of the contact springs are spring biased against the bottoms of the flanges 74 to spring bias the flanges against the lamp contacts 64 to provide continuous electrical contact at this point. An electrically conductive contact 78 encircles each mounting sleeve 70 and bridges the space between the two sleeves. The contact springs rest on opposite portions of the contact for making continuous electrical contact with it. A common lower terminal of the contact 78 projects down through a slot 80 in an opening 82 extending through the contact spring deck 66. The terminal from the contact 78 makes electrical contact, through an appropriate electrical circuit in the switch housing, with an elongated terminal pin (not shown) projecting out below the base of the switch outer housing. Electrical power supplied between this terminal pin and the common ground operates the lamps 43.

Referring again to FIG. 1, the message screen 26 is mounted to the upper portion of the message screen capsule 84, which, in turn, is mounted in the hollow interior region inside the housing on the side of the light-splitting blade 46 opposite the legend screen 28. The message screen capsule 84 also can be referred to as a flow bar housing. A group of push button switches often are arranged on an aircraft instrument panel to visually form a "flow bar" when all switches in the group are actuated, i.e., in the on position. A portion of the flow bar can be provided by the background coloration of a lens 86 that forms the message screen. A message such as "on" is printed on the lens 86 and exposed when the switch is in the "on" position. In one embodiment, the lens is translucent so that back-lighting provided by a pair of lamps 88 can illuminate the message, if desired.

Figure 12:
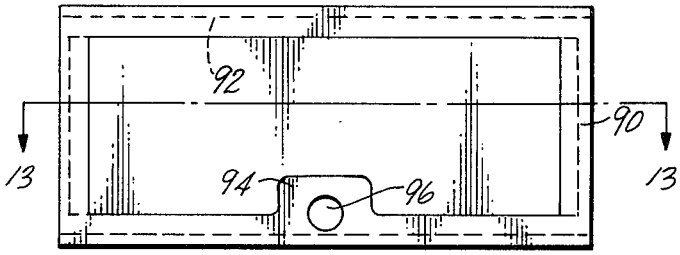
FIG. 12 is a bottom view showing a lens mount.
Figure 13:
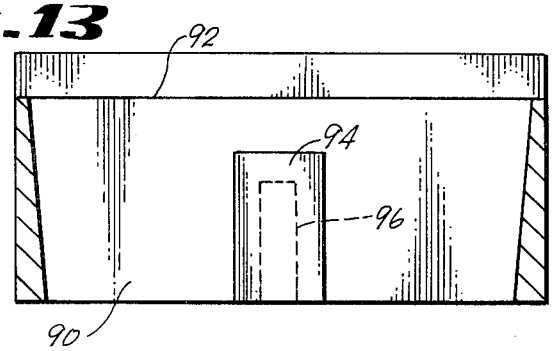
FIG. 13 is a cross-sectional view taken on line 13—13 of FIG. 12.

The upper portion of the message screen capsule is formed by an open-ended lens mount 90 having a generally rectangular narrow outer wall, as shown best in FIGS. 12 and 13. The lens mount has an internal ridge 92 on which the message screen is supported. An elongated vertically extending shoulder 94 projects into the interior opening through the lens mount.

A bore 96 extends into the shoulder from the bottom of the lens mount. The bore terminates short of the top of the shoulder, as illustrated best in FIGS. 1 and 13.

The lower portion of the message screen capsule is formed by an open ended shutter mounting block 98 (see FIGS. 10 and 11) having a rectangularly shaped, narrow tubular wall 100 that projects into the interior of the lens mount 90, as shown best in FIG. 1 The vertical shoulder 94 on the lens mount slidably interlocks with a cooperating upright groove 102 in an outer face of the tubular wall 100. The base of the lens mount rests on the top edge of a flange 104 at the bottom of the shutter mounting block. The shutter mounting block is movable vertically relative to the lens mount and the cooperating shoulder and groove guide relative movement between them. A vertical bore 105 extends through the lower flange 104 of the shutter mounting block below the groove 102. The base 105 of the shutter mounting block is aligned with the bore 96 in the lens mount.

The shutter mounting block is seated in the recess 56 of the lamp support base 52. A pair of side-by-side lamp receptacles 106 extend through the recess 56. The lamps 88 are mounted in the receptacle 106 from access provided from the underside of the lamp support base 52. Each lamp has an electrically conductive base in the lower portion of the receptacle and a lower contact 108 that faces down, away from the underside of the lamp support base.

FIG. 1 shows a pair of flexible, curved shutter blades 110 in their closed position projecting in front of and extending over the front face of the message screen 26. Lower portions of the shutter blades extend vertically in narrow spaces along opposite sides of the lens mount 90. The lower portions of the shutter blades are affixed to opposite sides of the shutter mounting block. The upper portions of the shutter blades curve toward one another and extend over the face of the message screen, with opposite ends of the shutter blades meeting via edge contact at a juncture spaced above the center of the message screen. The blades extend the entire width and length of the message screen so as to totally block off the message screen when the shutter blades are in their normally closed position shown in FIG. 1.

Figure 10:
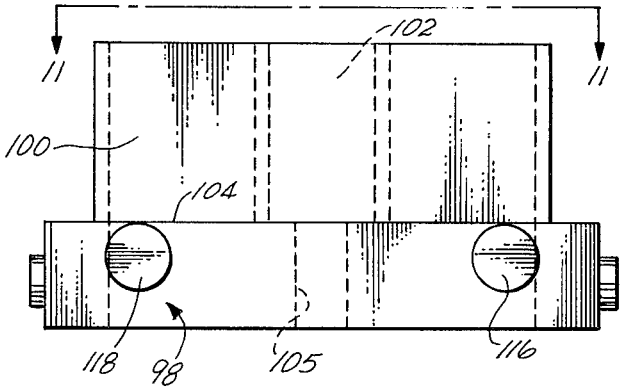
FIG. 10 is a side elevation view showing a shutter blade mounting block.
Figure 11:
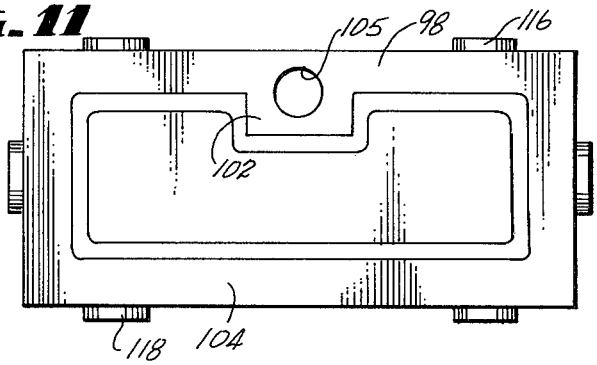
FIG. 11 is a top view taken on line 11—11 of FIG. 10.

As illustrated best in FIGS. 14 and 15, the lower portion of each shutter blade has a pair of spaced apart apertures 112 and 114. As shown in FIGS. 10 and 11, a separate pair of rounded projections 116 and 118 project outwardly from the side walls of the flanged lower portion of the shutter mounting block 98. Each pair of projections is engaged with a corresponding pair of apertures in a respective shutter blade for holding the shutter blades in a fixed position extending along opposite sides of the lens mount 90. The shutter blades are made of spring metal and each blade is a one piece thin metal blade from end to end. Each blade is normally flat along its lower portion, and the upper portion of each blade is normally curved, as shown in FIG. 14. In one embodiment, the shutter blades are 0.003 inch thick. The upper corners of the lens mount are rounded off, and the curved upper inside portions of the shutter blades are normally spring-biased into contact with the rounded corners of the lens mount.

An electrically conductive lamp bus 120 has a pair of electrical contacts engaged with the receptacles 106 in the lamp support base 52 for making electrical contact with the base of each lamp 88. A ring on the bus 120 encircles a short post 122 projecting down from the underside of the lens mount between the receptacles 106. An electrically conductive contact spring 124 is spring-biased into contact with the ring portion of the bus 120. The contact spring 124 is an elongated coil spring having its lower portion tapered narrower similar to a volute spring. The bottom of the contact spring 124 is biased against a flanged portion 126 of an elongated, vertically extending electrically conductive actuating rod 128. The actuating rod extends upwardly through a bore 130 in the lamp support base 52 and through the bore 105 in the shutter mounting block and into the bore 96 in the lens mount 90. This holds the actuating rod in a fixed position projecting down from the underside of the message screen capsule 84. The shutter mounting block is slidable, along the actuating rod, relative to the lens mount. An electrical circuit is provided between the flanged lower portion 126 of the actuating rod 28 through the contact spring 124 to the bus 120 and then to the base of the lamps 88. In one embodiment, 5 volt, 20 milliamp lamps 88 provide the back-lighting for the message screen 86.

An electrically conductive vertically extending spring-biased override pin 132 is positioned below the actuating rod 128. The vertical axis of the override pin is aligned with the vertical axis of the actuating rod, and a flanged contact tip 134 of the override pin is spaced a short distance below the lower contact 126 of the actuating rod. An electrically conductive override spring 136 spring-biases the contact tip of the override pin toward the actuating rod. The override pin is movably supported in a vertical sleeve 138 formed in the contact spring deck 66. The override spring 136 is an elongated coil spring that surrounds the override pin and has an upper portion that is tapered similar to a volute spring. The top of the spring is biased against the underside of the flanged contact tip of the override pin. The lower portion of the override spring is held in a fixed position by the sleeve 138 that supports the override pin. The override spring is a stiff spring having a greater spring stiffness than that of the contact spring 124 for the actuating rod. The greater stiffness of the override spring provides resistance against the downward travel of the actuating rod when the push button is depressed. The override spring keeps the push button from bottoming out when the push button is depressed.

The shutter blades 110 also are opened when the push button is depressed to actuate a switch in the lower portion of the outer housing. When the push button is depressed, the lens mount 90 and the shutter blade mounting block travel downwardly together until the bottom of the actuating rod contacts the top of the override pin. Further downward pressure on the push button then causes the actuating rod to be held in a fixed position by the override pin under the stiff bias of the override spring. This further downward pressure on the push button then causes the push button capsule, including the lamp support base 52 and the shutter mounting block 98, to continue travelling downward, while the lens mount 90 is held in a fixed position inside the push button capsule. That is, the shutter mounting block separates from the lens mount and moves downwardly away from the lens mount. This causes the shutter blades 110 to travel downwardly relative to the fixed lens mount. Since the curved upper portions of the shutter blades are spring-biased against the upper corners of the lens mount, the fixed lens mount exerts outward pressure on the downwardly travelling shutter blades to spread the shutter blades apart of expose the message on the message screen 86. At the full extent of the push button travel, the tips of the shutter blades are spread apart and forced outwardly into and retained in the narrow spaces alongside the upright outer wall of the lens mount. The shoulder 94 in the lens mount which interlocks with the groove 102 in the shutter blade mounting block guides the sliding relative movement between the lens mount and the shutter blade mounting block. When pressure is released on the push button so as to retract the push button to its normal position shown in FIG. 1, the push button capsule, including the shutter blade mounting block, moves upwardly toward the lens mount. This causes the shutter blades to travel upwardly relative to the upper corners of the lens mount, causing the normally curved upper portions of the shutter blades to automatically assume their normal position curved toward one another in the closed position shown in FIG. 1. Thus, each time the push button is depressed and then released, the shutter blades move down and automatically open to expose the message screen and then move up and close to block off the message screen. In one embodiment, the shutter blades are black so that the message screen is entirely blacked out by the closed shutter blades when the switch in the lower portion of the housing is in the "off" position.

Electrical power can be supplied to the lamps 88 for illuminating the message screen, if desired, to indicate the "on" position of the switch when the push button actuates the switch in the lower portion of the housing. The switch can be held in the "on" position, and the shutters held in their open position, while the switch is retained in the "on" position. Illumination for the message screen is provided by an electrical circuit which, in part, is provided by the bottom of the override spring being in constant contact with an electrically conductive contact 140. This contact surrounds the sleeve 138 on the contact spring mounting deck 166. The contact 140 has an elongated terminal 142 that extends below the contact spring mounting deck. The contacts 108 at the bottom of the lamps 88 are in constant contact with a corresponding pair of elongated electrically conductive contact pins 144. These contact pins extend vertically below the lamp contacts 108, and flanged upper portions 146 of these contact pins engage the lamp contacts. The lower portions of the contacts 144 are held in a fixed position in corresponding vertically extending mounting sleeves 148 in the contact spring mounting deck. The contact pins 144 are biased against the lamp contacts by corresponding electrically conductive contact springs 150 having their upper portions biased against the underside of the flanged portions 146 of the contact springs. These contact springs are elongated coil springs that surround the corresponding contact pins. The lower portions of the contact springs are held in a fixed position by the sleeves 148 that support their corresponding contact pins. The lower portion of each contact spring 150 rests on a corresponding ring-shaped portion 152 of an electrically conductive contact (not shown) that encircles each sleeve 148 of the contact spring mounting deck. These two ring-shaped portions of the contact are joined together to a single elongated ground terminal (not shown) that extends down below the contact spring mounting deck.

Electrical power can be supplied to the lamps 88 when contact is made between the contact 126 at the base of the actuating rod and the contact 134 at the tip of the override pin. This completes a circuit from the terminal of the contact 140 through the override spring and the contact spring 124, through the lamp bus 120 to the lamp base, and then through lamp and contact 108 the contact spring 150 to the ground contact 152 and its ground terminal 154. Thus, whenever electrical power is supplied between the ground terminal of the contact 152 and the terminal of the contact 140, the lamps 88 are turned on to illuminate the message screen.

The message screen shutter blades are normally closed when the switch in the lower portion of the outer housing is in the "off" position. The shutter blades thus black out the message screen, indicating the off position of the switch. When the push button is depressed to actuate the switch, the shutter blades automatically open to expose the message, i.e., the word "ON", printed on the message screen. In ambient light conditions where the message screen is readable, there is no need to power the lamps 88 for back-lighting the message screen. The message screen and shutter blades, thus, can reveal the "on" or "off" position of the switch without requiring electrical power to be supplied to the lamps 88 in either instance. However, if back-lighting of the message screen is required, such as in low ambient light conditions, then electrical power can be supplied to power the lamps 88.

Referring again to FIGS. 6 through 9, the contact spring mounting deck 66 has a pair of posts 156 extending upwardly toward the push button capsule. These posts act as stops for the downward travel of the push button capsule.

An elongated cam actuating shaft 158 extends vertically downwardly below th lamp support base of the push button capsule. The upper portion of the cam actuating shaft is affixed in a bore 160 through the sleeve 65 that projects down below the lamp support base. An intermediate portion of the cam actuating shaft is guided for sliding movement in an elongated, vertically extending sleeve 161 in the contact spring mounting deck. An electrically conductive common ground contact spring 162 surrounds the cam actuating shaft. The contact spring is a coil spring having its upper portion in constant electrical contact with the electrical contact 64 for the lamps 43. The lower portion of the contact spring is held in place by surrounding the sleeve 161 of the contact spring mounting deck. The base of the contact spring rests on and is in electrical contact with a ground contact 164 that surrounds the sleeve 161. The ground contact 164 extends through and below the contact spring mounting deck. Electrical power is supplied between the terminal of the contact 164 and the terminal leading from the contact 78 to power the lamps 43.

The lower portion of the cam actuating shaft has a laterally extending cam actuating pin 166 that engages a cam 168 in the housing spaced below the contact spring mounting deck. The structure and function of the cam can vary, depending upon its purpose. The cam can be part of an "alternate action" cam assembly for latching the push button in its depressed position for holding the switch contacts closed on alternate actuations of the push button capsule. The cam actuating pin 166 can be part of a mechanism that causes the pin to ride in a cam groove formed in the alternate action cam. As the push button moves up and down vertically, the pin travels around the cam groove and makes contact with various cam surfaces of the groove. The travel of the pin in the cam groove is controlled by the upward and downward movement of the cam actuating shaft in response to corresponding upward and downward movement of the push button capsule. When the push button is depressed for turning the switch to the on position, the pin can travel in the cam groove to a position which latches the push button in its "on" position after the downward pressure on the push button is released. The latch will then hold the switch in the "on" position until the next actuation of the push button, which then causes the pin to travel further along the cam groove to its "home" position where the push button is then held in its "off" position. Although a variety of arrangements can be used, one arrangement for such a cam mechanism is described in greater detail in application Ser. No. 47,028, filed June 11, 1979, which is owned by the assignee of this application and incorporated herein by this reference.

Figure 16:
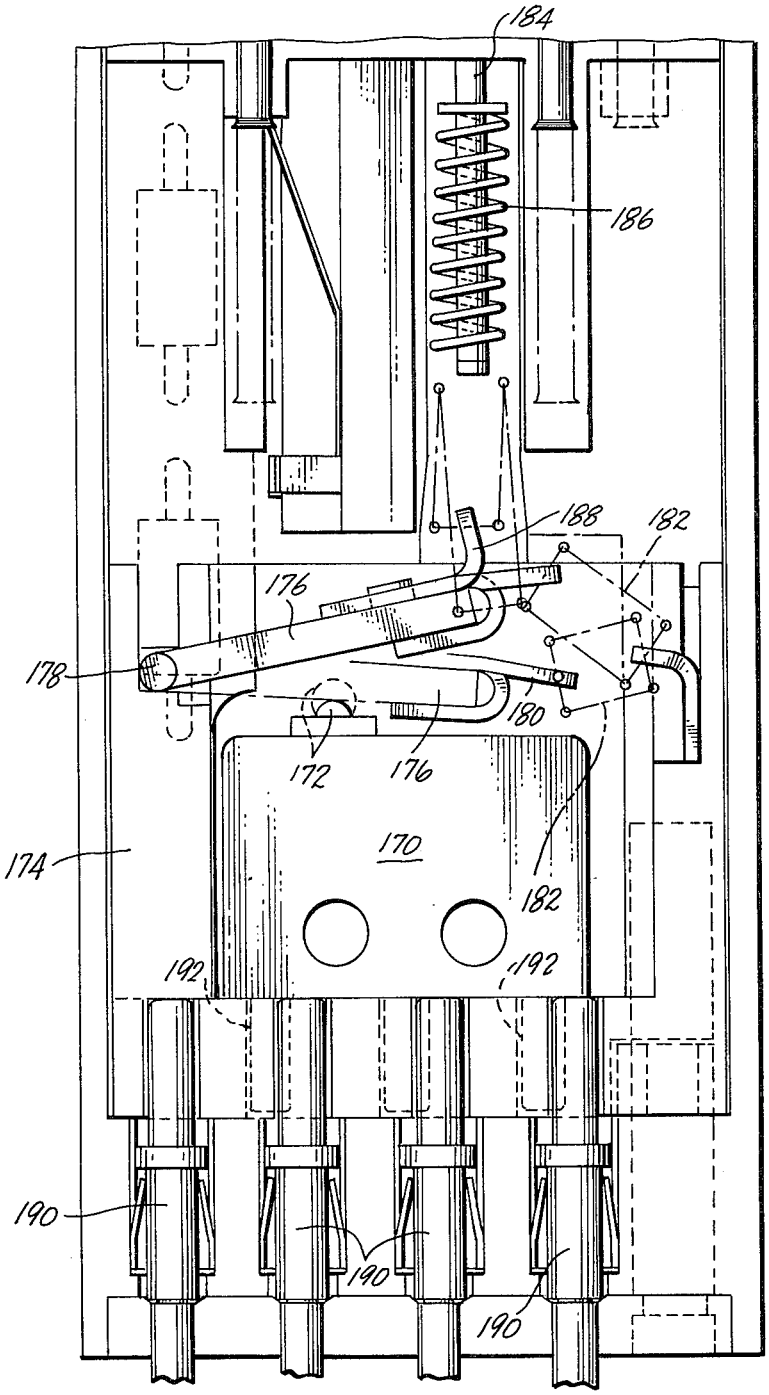
FIG. 16 is a fragmentary elevation illustrating a switching mechanism for the push button switch.

Referring to FIG. 16, when the push button capsule is depressed, one or more switches 170 are actuated. The switches 170 can be separate sub-miniature switches, preferably the type of switch that is actuated by a push button contact 172 that can be depressed by a downward pushing force and automatically released with the pushing force is released. As described above, the cam mechanism can latch the switch contact in the closed or "on" position after the pushing force is released on alternate actuations of the push button capsule. The sub-miniature switch is an on/off type switch that alternately makes and breaks electrical contact when the push button contact 100 is depressed and relaeased. A preferred subminiature switch is switch SB3-100034, manufactured by Otto Controls. In one embodiment, there are four of these switches which are mounted side-by-side inside a switch capsule 174 mounted in the lower portion of the housing 20.

A toggle mechanism applies a downward pushing force to the push button contacts of the switches and releases the pushing force for simultaneously turning the switches to the "on" and "off" positions. The structure of the toggle mechanisms can vary; and in the embodiment illustrated in FIG. 16, the toggle mechanism includes a flat plate-like toggle arm 176 adapted to pivot down and up between two positions illustrated in FIG. 16. The toggle arm can pivot down into contact with the push button contacts 172 of the switches to depress them (as shown in solid lines in FIG. 16), and the toggle arm can pivot up to release the actuating force from the push button contacts 172 (as shown in phantom lines in FIG. 16). One end of the toggle arm has a pivot 178 for pivoting the arm about a fixed axis between the depressed and released positions. A toggle clip 180 attached to the end of the toggle arm opposite the pivot engages a pair of toggle springs 182 (illustrated schematically in phantom lines in FIG. 16). The toggle springs are coil springs which are affixed at their opposite ends to toggle clips 184 secured to the inside wall of the switch capsule 174. This arrangement allows the toggle arm 176 to pivot about the axis through the pivot 178 for moving the arm through an arc between the depressed and released positions shown in FIG. 16. The toggle springs control the arcuate movement of the toggle arm.

A clip equalizer 184 has a central portion shaped as a post for bearing on the top face of the toggle clip. A pair of toggle pre-load springs 186 are biased between upper portions of the equalizer and projecting portions 188 of the toggle clip. When the push button capsule is fully depressed, the equalizer moves down so its post can apply a downward pushing force to the face of the toggle clip, at a point spaced from the pivot axis of the toggle arm. This causes the toggle arm to rotate downwardly to its depressed position and move the push button contacts 172 into their closed position. When the pushing force is released the toggle arm moves upwardly under the control of the toggle springs and the equalizer also moves upwardly under the control of the toggle pre-load springs. Electrical contact pins 190 make electrical contact with terminals 192 at the base of the switches to supply electrical power to the exterior of the switch housing.

Thus, the present invention provides a push button switch having a self-indicating message display in which a legend on the face of the push button can be entirely blacked out so it cannot be read even in high ambient light conditions. The message screen is readable in ordinary or high ambient light conditions without requiring constant electrical power to the lamps to provide back-lighting for the message. If continuous back-lighting is used for the legend screen, the brightness of the light is sufficient to ensure the legend screen can be read in low as well as high ambient light conditions. If the brighly illuminated lamps are on for a continuous period and generate a large amount of heat, the heat can be dissipated by the heat sink to avoid an inordinate amount of heat transfer to the face of the push button. The flexible shutter blades close and open without requiring any complex hinge or gear mechanisms.

What is claimed is:

1. A push button switch with self-indicating message display comprising:

a housing;

a switch mounted in the housing;

a push button having a face projecting from the housing;

means linking the push button to the switch for actuating the switch when the push button is depressed into the housing;

a shutter blade capsule in the housing secured to and movable with the push button;

a message screen positioned inside the capsule facing the face of the push button;

the shutter capsule including at least a pair of flexible shutter blades on opposite sides of the shutter blade capsule, the shutter blades having ends normally projecting toward one another to form an enclosure, the message screen being covered by the shutter blades to obscure the message screen;

means including a rod projecting outside the capsule for movably supporting the screen inside the capsule;

a contact pin supported by the housing and engaging the projecting end of the rod when the push button and capsule are pushed into the housing to activate the switch, the pin limiting the movement of the rod and associated screen relative to the capsule to permit relative movement between the screen and shutter blades for spreading apart the blades to expose the screen;

lamp means in the capsule for back-lighting the message screen; and means including the rod and pin for connecting a source of electrical power to the lamp means, the rod and pin forming a pair of electrical contacts for completing an electrical circuit to the lamp means when the rod is moved into contact with the pin.

2. Apparatus according to claim 1 in which the shutter blades each comprise thin strips of spring metal normally in spring-biased contact with opposite corresponding portions of the shutter blade capsule.

3. Apparatus according to claim 2 in which an upper portion of the shutter blade capsule is normally in spring-biased contact with the shutter blades; and in which the lower portions of the shutter blades are affixed to a lower portion of the capsule which is movable downwardly away from the upper portion of the capsule to spread apart the shutter blades by contact between the downwardly moving blades and the fixed upper portion of the capsule.

4. Apparatus according to claim 3 in which lower portions of the shutter blades extend along opposite sides of the shutter blade capsule generally parallel to the axis of travel of the push button; and in which intermediate inside portion of the blade members are normally biased against opposite sides of the capsule upper portion, and opposite upper portions of the shutter blades are curved toward each other and extend over the upper portion of the capsule.

5. Apparatus according to claim 4 in which the upper portions of the shutter blades are forced apart to extend along opposite sides of the capsule upper portion generally parallel to the axis of travel of the push button when the shutter blades are moved down relative to the capsule upper portion.

6. Apparatus of claim 1 further including spring means connected between the rod and the push button normally urging the rod and associated message screen away from the face of the push button, the rod moving the screen toward the face of the push button against the urging of the spring means when the rod engages said pin, and spring means connected between the pin and the housing for allowing movement of the message screen with the push button when the screen engages the face of the push button.

7. A push button switch with self-indicating message display comprising:

a housing;

a switch mounted in the housing;

a push button having a face projecting from the housing;

means linking the push button to the switch for actuating the switch when the push button is depressed into the housing;

a shutter blade capsule in the housing;

a message screen in the capsule facing the face of the push button;

at least a pair of flexible shutter blades on opposite sides of the shutter blade capsule, the shutter blades normally projecting above the shutter blade capsule toward one another over the capsule to normally obscure the message screen;

means for moving at least a portion of the shutter blade capsule downwardly into the housing relative to the message screen, in response to the push button being depressed into the housing when actuating the switch, for spreading apart the shutter blades to expose the message screen;

a legend screen in the housing adjacent the message screen, the legend screen having a legend;

means for scattering ambient light on the legend screen to normally obscure the legend; and means for back-lighting the legend on the legend screen to display the legend.

8. Apparatus according to claim 7 including means in the housing between the back-lighting means and the legend screen for forming a light pipe for the legend on the legend screen.

9. Apparatus according to claim 7 including a heat sink surrounding the back-lighting means to reduce heat transfer to the face of the push button from the back-lighting means.

* * * * *